United States Patent [19]

Artzt et al.

[11] Patent Number: 4,845,936

[45] Date of Patent: Jul. 11, 1989

[54] PROCESS AND DEVICE TO PIECE BACK TO A SPINNING DEVICE OPERATING WITH A PNEUMATIC TORSION ELEMENT

[75] Inventors: Peter Artzt; Harald Dallmann, both of Reutlingen; Kurt Ziegler, Kirchheim-Nabern; Gerhard Egbers, Reutlingen, all of Fed. Rep. of Germany

[73] Assignee: Schubert & Salzer Maschinenfabrik, Ingolstadt, Fed. Rep. of Germany

[21] Appl. No.: 90,708

[22] PCT Filed: Nov. 12, 1986

[86] PCT No.: PCT/DE86/00459

§ 371 Date: Jul. 10, 1987

§ 102(e) Date: Jul. 10, 1987

[87] PCT Pub. No.: WO87/03310

PCT Pub. Date: Jun. 4, 1987

[30] Foreign Application Priority Data

Nov. 21, 1985 [DE] Fed. Rep. of Germany ..... 3541218

[51] Int. Cl.[4] ..... D01H 15/00; D01H 5/28

[52] U.S. Cl. ..... 57/261; 57/328

[58] Field of Search ..... 57/261–263, 57/328, 22

[56] References Cited

U.S. PATENT DOCUMENTS

| | | | |
|---|---|---|---|
| 4,457,130 | 7/1984 | Sakai et al. | 57/333 X |
| 4,503,662 | 3/1985 | Horiuchi et al. | 57/261 |
| 4,517,794 | 5/1985 | Sakai et al. | 57/261 X |
| 4,543,776 | 10/1985 | Seiki et al. | 57/261 |
| 4,545,193 | 10/1985 | Tanaka et al. | 57/261 |
| 4,550,560 | 11/1985 | Tanaka et al. | 57/261 |
| 4,620,413 | 11/1986 | Anahara | 57/261 |

FOREIGN PATENT DOCUMENTS

| | | |
|---|---|---|
| 2223638 | 1/1973 | Fed. Rep. of Germany . |
| 3235769 | 7/1983 | Fed. Rep. of Germany . |
| 3336294 | 4/1984 | Fed. Rep. of Germany . |
| 3337120 | 4/1984 | Fed. Rep. of Germany . |
| 3411577 | 10/1984 | Fed. Rep. of Germany . |
| 3413894 | 10/1984 | Fed. Rep. of Germany . |
| 3318266 | 11/1984 | Fed. Rep. of Germany . |
| 1540425 | 8/1968 | France . |
| 59-76933 | 5/1984 | Japan . |

*Primary Examiner*—John Petrakes

*Attorney, Agent, or Firm*—Dority & Manning

[57] ABSTRACT

For piecing to a spinning device operating with a pneumatic torsion element, yarn is fed back through the torsion element into a readiness position alongside a drafting mechanism, while the roving is stopped before the end of the drafting zone. The roving is then released, whereby the forward roving end which is leaving the drafting mechanism, and which typically is rendered unsuitable for piecing due to stoppage of the roving, is sucked off. When a roving segment which remained in the drafting mechanism during the prior roving stoppage has been taken away, the roving and the yarn end are brought together and are simultaneously fed to the torsion element so as to be combined. To carry out this process, the drafting mechanism preferably includes before the end of its drafting zone at least one roving stopping device which may be controllable with feedback from a yarn monitor located adjacent the path of yarn being conveyed to a yarn take-up mechanism, such as a bobbin. Furthermore, a suction nozzle can be selectively situated and activated between a pair of exit rolls of the drafting mechanism and the torsion element, for removing controllably the forward end of a roving rendered unsuitable for piecing by stoppage of such roving.

24 Claims, 4 Drawing Sheets

50
5
90
9
51
52
4
41
40
70
710
910
91
71
83
60
6
830
3
230
8
23
811
82
80
223
222
220
22
831
221
2
21
810
81
820
24
241
210
7
211
240
201
72
200
241

PROCESS AND DEVICE TO PIECE BACK TO A SPINNING DEVICE OPERATING WITH A PNEUMATIC TORSION ELEMENT

BACKGROUND AND SUMMARY OF THE INVENTION

The instant invention relates to a process for piecing back to a spinning device operating with a pneumatic torsion element in which a yarn which is fed back to a drafting mechanism is brought together with a roving, as well as to a device to carry out the process.

In a known process of this type the pair of intake rolls of the drafting mechanism is stopped for the purpose of piecing back when a yarn breakage occurs, so that the roving or the fiber sliver is opened in the drafting zone which follows this pair of intake rolls (DE-OS 3,411,577 and 3,413,894 corresponding with U.S. Pat. Nos. 4,550,560 and 4,545,193, respectively). When the fiber sliver or the roving is fed back to the torsion element for piecing, an irregularity is produced which must be removed from the finished yarn in a further step.

It is therefore the objective of the instant invention to create a process and a device which makes it possible to produce an unobtrusive piecing joint with little expenditure.

This objective is achieved according to the invention in that the roving, after being stopped, is at first released for the piecing process and in that the forward end of the roving which is leaving the drafting mechanism is sucked away until the roving segment which has remained in the drafting mechanism during the prior stoppage of the roving has been taken away, and in that the roving is subsequently fed to the torsion element while being simultaneously brought together and combined with the yarn end. Due to the stoppage of the roving or of the fiber sliver said roving or said fiber sliver is not only discontinued, but its forward end is given an irregular shape which is unsuitable for piecing. Therefore the removal of this affected forward end of the roving or sliver ensures that in piecing a segment with unaffected fiber orientation and length is fed to the torsion element to be combined with the yarn. In this way, even and unobtrusive piecing joints are obtained.

In the sense of the instant invention, roving is understood to be any sliver-like material which can be fed to the torsion element by means of a drafting mechanism, regardless of whether it has little torsion or not. Not only flyer rovings but also card slivers etc. fall therefore into this category.

In order to coordinate the re-starting of yarn torsion in a particularly simple manner with the beginning of yarn draw-off, whereby the length of the piecing joint can be predetermined precisely, it is preferable to draw off the yarn at first through the torsion element without it exerting any twisting action upon the yarn, whereby furthermore, in function of the position of the end of the yarn previously fed-back, the removal of the roving is ended and the feeding of the roving to the torsion element is started, roving and yarn now being submitted together to the twisting effect which now begins.

It is basically sufficient if the yarn and the stretched roving are allowed to run together into the twisting nozzle. However, the longer the common conveying path of roving and yarn between drafting mechanism and torsion element, the better the piecing joint. For this reason provisions can be made in a preferred embodiment of the inventive process for the yarn to be introduced laterally into the closed clamping line of the two output rolls and to be fed necessarily to the torsion element at the speed determined by the rotational speed of the two output rolls.

To prevent the injector effect in the torsion element from provoking uncontrolled draw-off of the yarn after the feeding of compressed air is resumed provisions are made in a preferred version of the process for the yarn which is brought together with the roving to be retained pneumatically and to be furthermore braked mechanically upon resumption of yarn draw-off until part of it is brought together with the roving. The yarn is thus drawn off at a draw-off speed which is dictated mechanically by the winding device or by a pair of draw-off rolls. Beyond this, the yarn in the process of draw-off is controlled between yarn holding device and torsion element until further controlled yarn draw-off is ensured by bringing together the yarn and the roving. Perfect and unobtrusive piecing joints are ensured in this way.

The success of the piecing process does not only depend upon the state of the forward end of the roving but also upon the state of the yarn end. For this reason it is advisable for the end of the yarn which is to be brought together with the roving to be subjected to a pre-treatment before this joining together. This is done preferably by measuring out the yarn to a defined length. The position of the yarn end in the process of being drawn off and which is thus brought to a determined length can then be sensed and can be used as a basis to control further phases of operations in the piecing process, for example in starting roving feeding, in controlling roving suction, in controlling compressed air feeding to the torsion element, etc.

To carry out the process the invention provides for the mouth of a suction nozzle to be brought into action alongside the conveying path of the fiber material between the two outlet rolls of the drafting mechanism and the torsion element. Before piecing the roving is not conveyed through the drafting mechanism but is stopped by the roving stopping device. Depending upon the configuration of the roving stopping device (for example a stoppable pair of intake rolls of the drafting mechanism or a roving clamping device) the forward end of the roving is given a form which makes it impossible to obtain an unobtrusive piecing joint, so that said joint must be removed in a subsequent cleaning process. In order to avoid this, the instant invention provides, after release of the roving, for the affected forward end of the roving to be taken away by means of the suction nozzle mouth which can be activated alongside the conveying path of the fiber material, so that a faultless segment of roving then becomes available for piecing.

To be able to precisely synchronize the moment at which the spinning overpressure in the torsion element is switched on with the moment when yarn draw-off begins and when the negative pressure at the suction nozzle is switched off, the suction nozzle and the torsion element can be connected via a control device to a yarn-end supervision device which is attributed to the pneumatic yarn holding device for this switching off of the negative pressure at the suction nozzle and switching on the overpressure at the torsion element. In this way, a defined transfer of the forward end of the roving from the suction nozzle to the torsion element is achieved, and this is essential for the obtention of good piecing joints.

To exclude uncontrolled yarn movement and uncontrolled start-up thereof through the pneumatic torsion element when the yarn running into the torsion element is being held in a pneumatic yarn holding device, and thereby to avoid irregular piecing joints, this pneumatic yarn holding device is advantageously associated with a yarn brake which acts upon the yarn in the process of draw-off.

In order for the yarn to be fed back without interference, the yarn brake is preferably controllable by means of a controlling device and can be brought by said controlling device into or out of the path of the yarn extending into the yarn holding device. It is advantageous here, in order to ensure faultless guidance of the yarn with respect to the yarn brake, if said yarn brake is located in the yarn holding device which is fashioned as a suction pipe.

However, the quality of the piecing joints is not only influenced by the shape of the forward end of the roving but also by the shape of the yarn end. To ensure that not only a forward end of the roving of perfect quality but also a defined yarn end is available for piecing, a pre-treatment device which can be used on the yarn is suitably provided in a further embodiment of the object of the invention. This pre-treatment device is preferably made in the form of a yarn separating device and is installed in the yarn holding device which is made in form of a suction pipe.

It is customary to carry out piecing with the help of a piecing carriage which can travel alongside the machine and which can be brought to any spinning station at will. In this case the controlling device for piecing is advantageously installed on the piecing carriage, especially the suction nozzle, the yarn holding device as well as a controlling device which can be brought to bear upon the roving stopping device.

To avoid that the pneumatic yarn holding device cover long distances or any distance at all during feed-back of the yarn, the torsion element can, in addition to a first set of compressed air bores with a direction component in the direction of yarn draw-off and which are subjected to compressed air during normal spinning operation, be furthermore associated with a second set of compressed air bores with a direction component in feed-back direction and which are subjected to compressed air during the feed-back of the yarn into piecing position. The torsion element is preferably associated with a first stop which determines the spinning position of the torsion element and which is provided with a first compressed air feeding opening that can be connected to the first set of compressed air openings, as well as with a second stop which determines the threading position and which is provided with a second compressed air feeding opening which can be connected to the second set of compressed air openings.

Preferably each of the two compressed air feeding openings can be provided with a check valve which can be opened by application of the torsion element to the corresponding stop. The second stop is suitably installed on a piecing carriage which can travel alongside the machine and can be brought to any spinning station at will.

To suck away the fly which is produced in continuous spinning operation and to take away a ruptured yarn segment, a preferred embodiment of the object of invention is equipped with a suction nozzle after the torsion element (as seen in spinning direction) near said torsion element and directly next to the yarn conveying path.

The invention ensures reliable piecing and unobtrusive piecing joints with a device of simple design. Only orderly material is presented for piecing, so that no danger exists for the torsion element to become clogged because of non-oriented fibers and consequently for yarn breakage to be provoked.

BRIEF DESCRIPTION OF THE DRAWINGS

The invention is described in greater detail hereinbelow with reference to embodiments thereof illustrated in the accompanying drawings.

DETAILED DESCRIPTION OF THE PREFERRED EMBODIMENT

Figure 1:
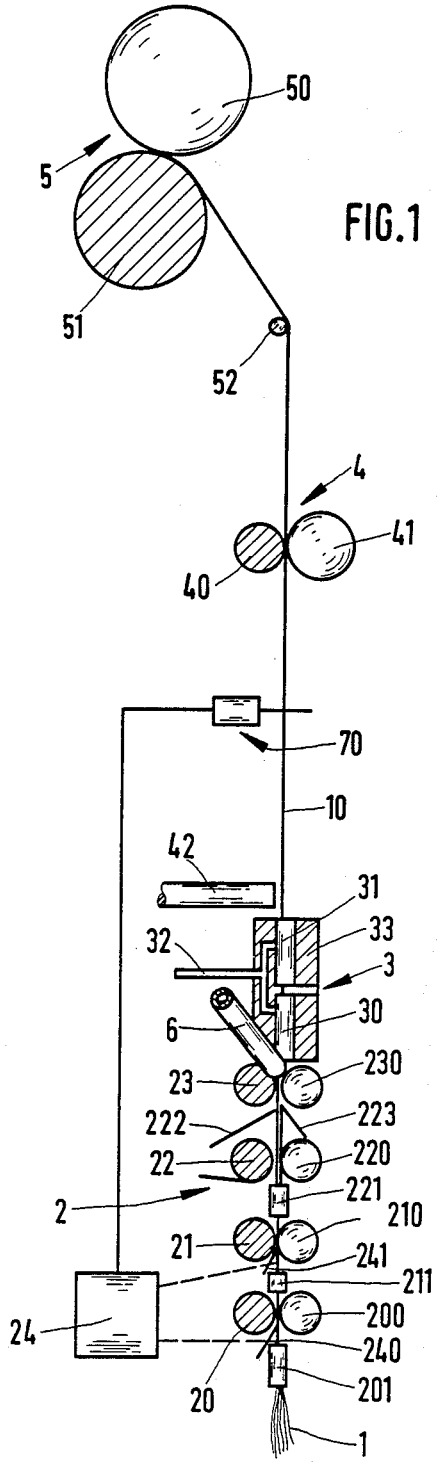
FIG. 1 shows a schematic side-view of a spinning device designed according to the invention.

The design of the spinning device is first explained through FIG. 1. In the spinning device shown, a roving 1 or a fiber sliver is drawn to the desired yarn thickness by means of a drafting mechanism 2 and is then fed to a pneumatic torsion element 3 where the roving 1 or the fiber sliver is spun into a yarn 10. Yarn 10 is drawn out of the torsion element 3 by means of a pair of draw-off rolls 4 and is fed via a yarn tension compensation hoop 52 to a winding device 5 where the yarn 10 is wound on a bobbin 50. Bobbin 50 is driven by a bobbin roll 51.

The drafting mechanism 2 shown as an example is equipped with four pairs of rolls with rolls 20/200, 21/210, 22/220 and 23/230. Before the rolls 20, 200 of the first pair of rolls and between the rolls 20, 200-21, 210-22, 220 of the first and second as well as of the second and third pair of rolls there are the compressors 201, 211 or 221, preventing excessive spreading of the roving 1 in the drafting mechanism 2. In front of the rolls 21, 210 of the third-before-last pair of rolls as well as in front of the rolls 20, 200 of the pair of rolls upstream from these, the roving clamping devices 241 or 240 are installed and are associated with a joint driving device 24.

The small belts 222 and 223 loop around the two rolls 22, 220.

A suction nozzle 6 is installed next to the conveying path of the fiber material between the rolls 23, 230 of the pair of output rolls of the drafting mechanism 2 and the torsion element 3.

The yarn is imparted false torsion by the compressed air fed to the pneumatic torsion element through a controllable compressed air line 32, said false torsion being removed subsequently to a great extent. For this purpose the shown torsion element is equipped with an injection nozzle 30 and a torsion nozzle 31 after it, carried by a joint holder 33. As the false torsion is imparted and as it is removed the fiber ends are tied into the yarn core while loops are being formed and thus cause a true core torsion to remain in the yarn so that the latter possesses the desired strength.

Figure 2:
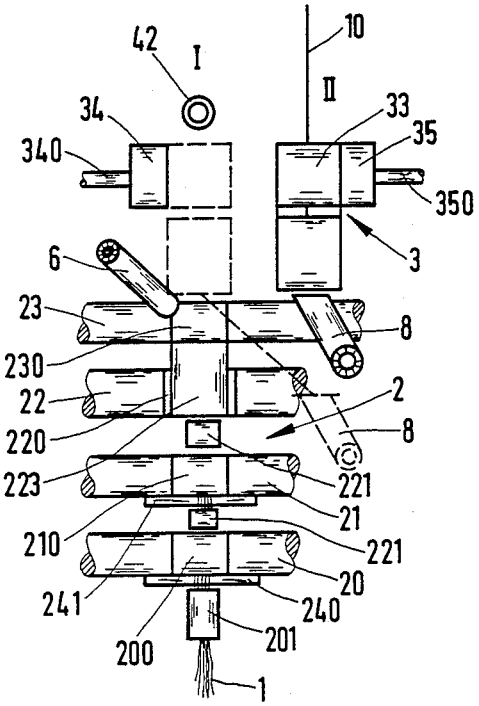
FIG. 2 shows the spinning device of FIG. 1 in the threading/feed-back phase, in top-view.

The holder 33 is supported in a movable fashion so that the torsion element 3 can be brought from a spinning position I into a threading position II and back again (FIG. 2).

The draw-off devices 4 consist as is usual of a driven draw-off roll 40 and of a pressure roll 41 which can be lifted off from said draw-off 40 roll and which is elastically pressed against it. On its way between the torsion element 3 and the draw-off device 4, the yarn 10 is monitored by a yarn monitor 70 which ascertains the presence of spinning tension. The yarn monitor 70 is controllably connected to drive 24 of the roving clamping devices 240 and 241 in order to stop the roving 1 in case of thread breakage, while rolls 20, 21, 22 and 23 of the drafting mechanism 2 continue to run.

Directly next to the path of the yarn, near the torsion element 3, between the latter and the yarn monitor 70, is located the mouth of a suction nozzle 42. It is the role of this suction nozzle 42 to suck away loose fibers which leave the torsion element 3 in form of fly when the spinning operation is interrupted.

When a yarn breakage occurs, the response of the thread monitor 70 and the activation of the roving clamping devices 240, 241 cause the roving 1 to be broken downstream from the roving clamping device 241 due to the continued running of the drafting mechanism 2. This portion of roving 1, which continues to be fed through the drafting mechanism 2 to the torsion element 3 is spun into a short piece of yarn by said torsion element 3 which continues to be subjected to overpressure. Since this short piece of yarn is no longer in contact with yarn 10 which is wound on bobbin 50 as a consequence of the yarn breakage, it is now sucked away through suction nozzle 42.

Figure 3:
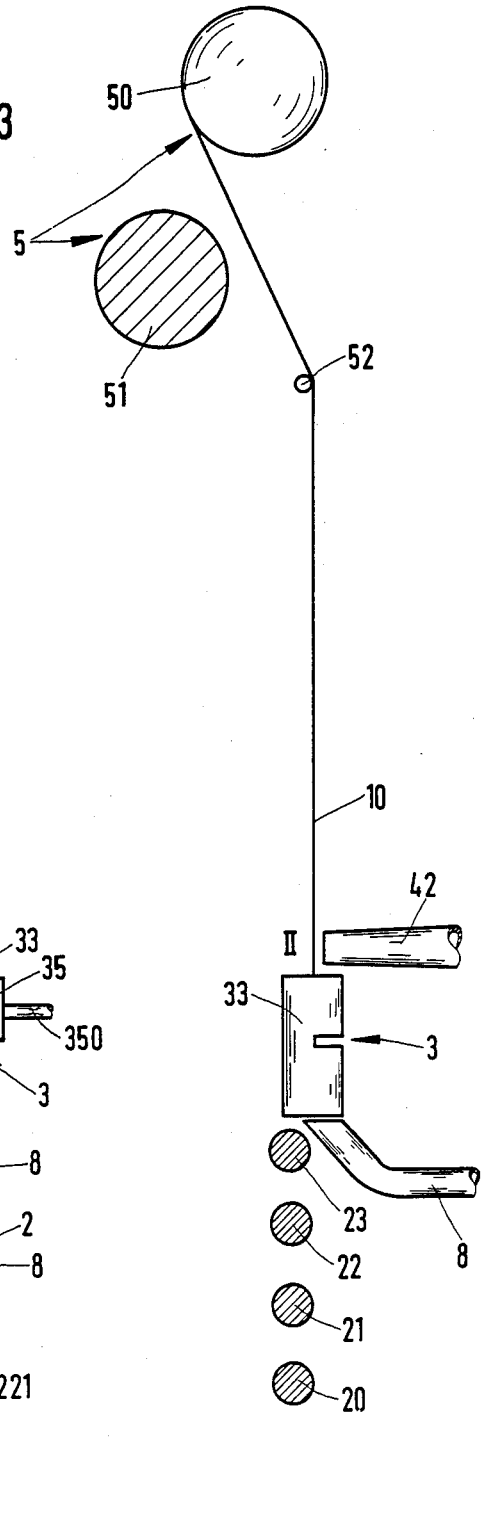
FIG. 3 shows a detail of FIG. 2 in a side view.

Simultaneously with the occurrence of a yarn breakage, bobbin 50 is lifted off from the bobbin roll 51 in a known manner (FIG. 3).

To piece the yarn, the swivelling holder 33 brings the torsion element 3 out of spinning position I into threading position II (FIG. 2) where the intake opening of the injection nozzle 30 is located directly in front of the mouth of a pneumatic yarn holding device 8. The spinning overpressure in the torsion element 3 is furthermore switched off.

The yarn end is sucked away in known manner through a swivelling suction pipe 91 (FIG. 6) from the bobbin 50 which is now driven in unwinding direction. As soon as the yarn end inside suction pipe 91 has reached a sufficient length, so that it is securely taken along by the suction pipe 91 even when the latter is swivelled, the yarn holding device 8, fashioned as a suction pipe, is brought from the yarn transfer position indicated by a broken line in FIG. 2 into a yarn receiving position near the outlet opening of the torsion element 3 which is now in threading position II. The yarn 10 which is held by suction pipe 91 is then cut in the known manner, so that it is sucked through the torsion element 3 upon subjection of the pneumatic yarn holding device 8 to negative pressure. Bobbin 50 is then stopped. If the transfer of yarn 10 to the pneumatic yarn holding device 8 is undertaken, reverse rotation of bobbin 50 can also be interrupted earlier and temporarily.

As shown in FIG. 2, the end of yarn 10 which has been fed back is now in a position of readiness alongside to the drafting mechanism 2 which has remained unaffected by the thread monitor 70 and therefore continues to be driven as before, while roving 1 however has been stopped before the drafting zone which is limited by the rolls 21, 210 and 22, 220.

Figure 4:
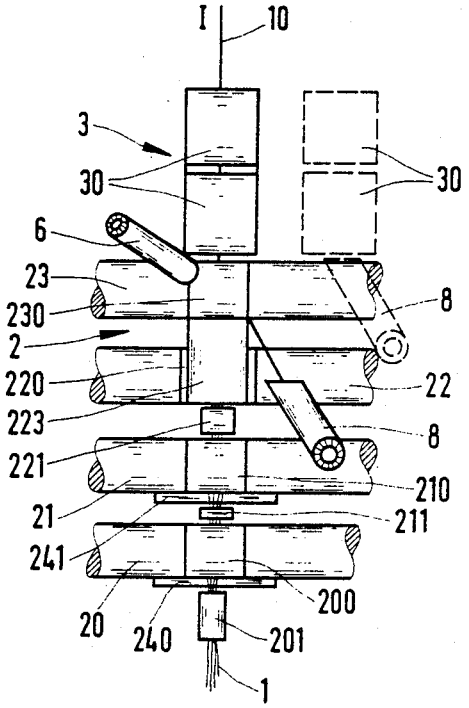
FIG. 4 shows the part of the inventive device of FIG. 3 in the piecing phase.

The torsion element 3 is now brought back into its spinning position I (FIG. 4) while the pneumatic yarn holding device 8 is brought out of the yarn receiving position (indicated by a broken line in FIG. 4) shown in FIG. 2 and into the position indicated by an unbroken line in FIG. 4 (yarn transfer position).

The suction nozzle 6 is now subjected to negative pressure. Roving 1 is then released by the roving clamping devices 240 and 241. The forward end of roving 1 has now a different form than during normal spinning operation because of the interruption of said roving 1 which was provoked upon occurrence of the yarn breakage and is not, or only in a limited way, suitable for piecing. For this reason the forward end of roving 1 is dissolved and sucked away by the negative pressure prevailing in suction nozzle 6 until a continuous flow of fiber material is again ensured. The beginning of the drawn roving 1 is then introduced into the torsion element 3 through discontinuance of the negative pressure at the suction nozzle 6 and resumption of overpressure in said torsion element 3 in which said roving 1 is combined with the yarn 10. The suction effect of the airstream produced in the torsion element 3 also draws off yarn 10 from the pneumatic yarn holding device 8. While the yarn end and the forward end of the roving are led together through the torsion element 3 they are combined.

In coordination with the release of roving 1 and with the resumption of air pressure in the torsion element 3 the bobbin 50 is lowered once more upon the bobbin roll 51. The draw-off tension which is now reestablished causes yarn 10 to be drawn into the clamping line of the pair of draw-off rolls 4. In this phase it is possible fo the pressure roll 41 to be lifted off from the driven draw-off roll 40 until the thread monitor registers that spinning tension has been reestablished.

The explained process as well as the described device can be modified in many ways. The replacement of characteristics by equivalents and other combinations thereof come within the framework of the instant invention. For example, instead of a drafting mechanism 2, with four pairs of rolls, it is also possible to use a drafting mechanism with only three or else with more than four pairs of rolls. In the latter instance a roving clamping device, fashioned in the conventional manner, is also installed before the third-before-last pair of rolls and before each pair of rolls before it. The torsion element 3 can (as shown) consist of an injector nozzle 30 and a twisting nozzle 31. For many purposes however, a single nozzle can be sufficient for the torsion element 3.

The roving stopping device can be fashioned in different ways. It is possible, for example, to attribute a coupling to the pair of intake rolls in order to stop roll 20. A roving stopping device in form of a roving clamping device is by comparison simpler in construction while affording equal reliability of operation.

According to the process described in FIGS. 1 to 4 the yarn 10 is brought into such a position by a movement that is axial as well as crosswise to the axis of the torsion element 3 so that the yarn segment which is stretched between the torsion element 3 and the pneumatic yarn holding device 8 is applied to the front of the roll 230 and is introduced from the side into the clamping line of the pair of exit rolls formed by rolls 23, 230 when said roll 230 rotates. The yarn 10 which is fed to the torsion element 3 is thus fed to said torsion element at a speed which is determined by the rotation of said rolls 23, 230. In this way, defined piecing conditions are obtained. To prevent uncontrolled drawing-off of the yarn 10 from the pneumatic yarn holding device 8 before its insertion into the clamping line of the pair of exit rolls, said yarn holding device 8 is equipped with a yarn brake 81 which elastically retains the yarn 10 in the process of being drawn off. Yarn 10 is then drawn off from yarn holding device 8 only at the speed which it is given by bobbin 50 and/or by the pair of draw-off rolls 4. This contributes to increased reliability in the piecing process.

As indicated in FIG. 2, it is often sufficient if the yarn is brought together with the roving 1 only at the entry into the torsion element 3. Uncontrolled drawing-off of the yarn 10 is prevented here too by the yarn brake 81.

Figure 6:
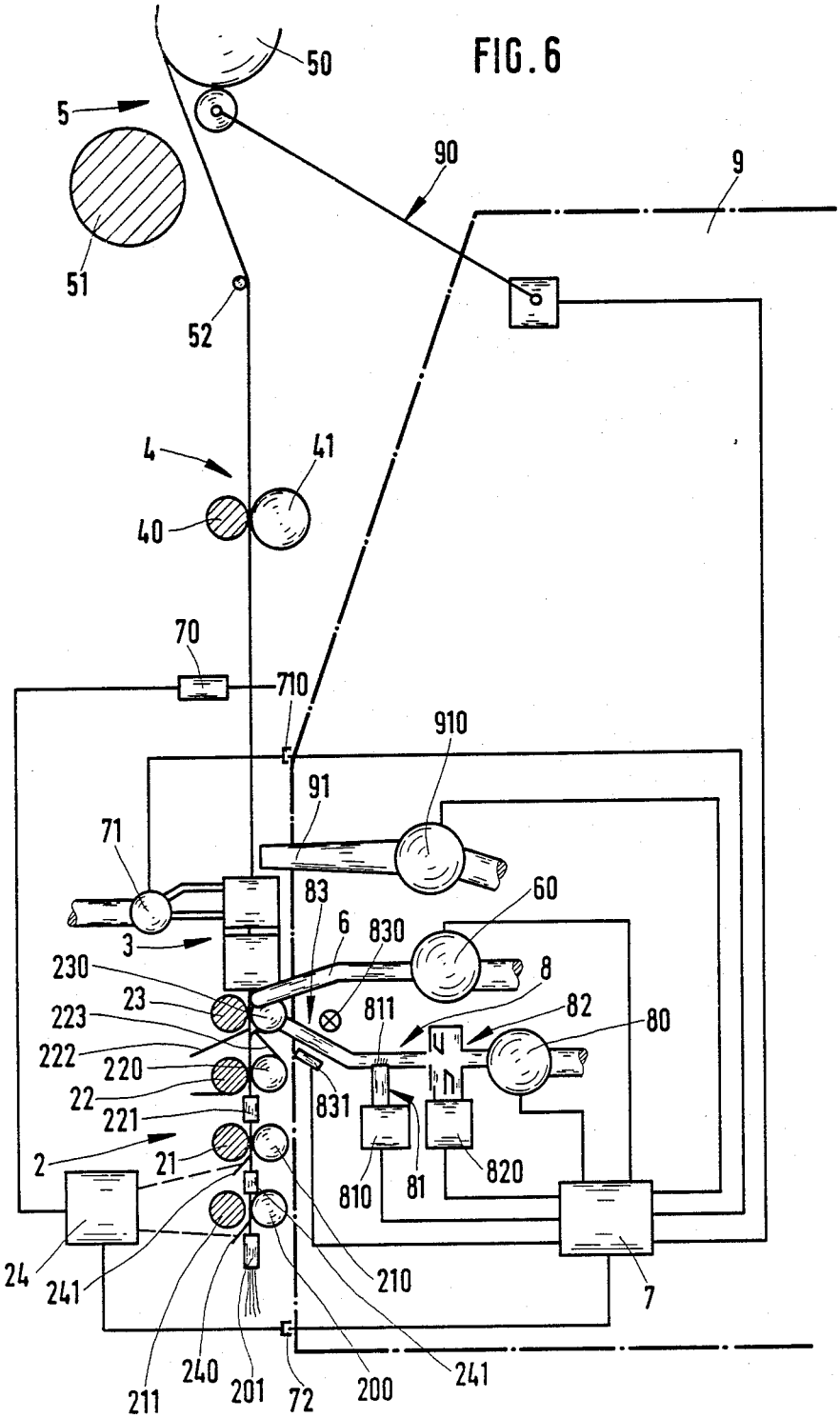
FIG. 6 shows a schematic side-view of a piecing device which is controlled from a service carriage.

In accordance with the embodiment indicated schematically in FIG. 6, the yarn brake 81 is made in form of a braking bolt 810 which is installed in the yarn holding device 8, fashioned as a suction pipe. Said braking bolt can be moved crosswise to the said yarn holding device's longitudinal axis and can be brought into contact with the opposite interior wall of said yarn holding device 8 by its stop surface which is equipped with a retaining clothing 811. Yarn 10 is braked mechanically by this yarn brake 81 until part of said yarn 10 has come into contact with roving 1 and is by then in full piecing process inside torsion element 3.

In order to obtain piecing joints of high quality a further variant of the process provides for the yarn end to be pieced to be given a defined form. For this reason the yarn end is subjected to a pre-treatment of a known type. Here, the yarn end can be untwisted by means of a pre-treatment device 82, it can be napped or simply be brought to a defined length by cutting.

FIG. 6 shows an example in which the pre-treatment device 82 is a yarn cutting device and is installed inside the yarn holding device 8 which is fashioned as a suction pipe.

In order to coordinate the beginning of the spinning process precisely with the resumption of yarn draw-off, provisions are made according to FIG. 6 for the pneumatic yarn holding device 8 to be associated with a yarn-end monitoring device 83. This device, which is only shown schematically, is provided with a light source 830, as shown in FIG. 6, and with a photoelectric cell 831 which is connected to control device 7. This control device 7 is connected to a valve 60 for the control of the underpressure in the suction nozzle 6 as well as to a valve 71 for the control of the overpressure in the torsion element 3. Thus, when the yarn 10 which is drawn off from the pneumatic yarn holding device 8 by the bobbin 50 and/or the draw-off device 4 reaches the light beam projected by light source 830 towards photoelectric cell 831 in the course of piecing, said light beam is released. This causes the control device 7 to switch off the negative pressure at the suction nozzle 6 and to switch on the overpressure at the torsion element 3. Other steps of operation of the piecing process, for example the application of a pressure roll 41 which has previously been lifted off from the driven draw-off roll 40, can be controlled as a function of the position of the yarn end.

According to FIG. 6 the control device 7 is installed on a piecing carriage 9 which can travel alongside the spinning machine to any one of a plurality of spinning stations in order to piece the yarn to the latter, as for example in order to repair yarn breakage.

To minimize construction expenses, all devices which are only needed during the piecing process are installed on this piecing carriage 9. In the embodiment shown in FIG. 6, the most essential of these elements are the suction nozzle 6 which sucks away the forward end of the roving and the pneumatic yarn holding device 8 with all devices which are associated therewith. Furthermore, the control device 7 can be controllingly connected with the driving device 24 for the roving stopping device, as is indicated schematically by a plug-in connection 72. Instead of the indicated plug-in connection 72 (or 710, for the valve 71 which is attributed to the torsion element 3) it is also possible to provide a different type of connection. For example, the piecing carriage 9 is constantly connected to the spinning machine via trailing cables (not shown) and is connected via an appropriate electric switch to each spinning station as it is being serviced.

As FIG. 6 shows, the control device 7 is controllably connected to a bobbin support and drive device 90. This device holds the bobbin 50 at a distance from the bobbin roll 51 during piecing and is turned back so that yarn 10 is fed back into the suction pipe 91. At the same time the bobbin support device and the bobbin drive device can also be elements which are independent of each other. The swivelling drive (not shown) as well as the control valve 910 for the suction pipe 91 are also controllingly connected to the control device 7. In addition to the above mentioned elements, a control valve 80 for the yarn holding device 8 and the drives 810 and 820 for the yarn brake 81 and the pre-treatment equipment 82 are also connected to the control device 7.

Furthermore the torsion element 3 is moved in and out of the spinning position I under control of the control device 7 in a manner which is not shown here.

The operation of the device shown in FIG. 6 is described below:

During piecing, the roving 1 is first of all released in the manner described and is taken away by the negative pressure prevailing at the suction pipe 6 after it leaves the pair of exit rolls constituted by the rolls 23, 230 of the drafting mechanism 2.

Furthermore, the yarn end being retained by the yarn holding device 8 is given a defined form, for example by brushing or by cutting the yarn end to a predetermined length.

In synchronization with this, yarn 10 is drawn off through the torsion element 3 by lowering the bobbin 50 on the bobbin roll 51 and/or by applying the pressure roll 41 on the draw-off roll 40 through the clamping of said yarn which is thus carried out. At this moment the torsion element 3 is however not yet subjected to any overpressure, so that no twisting action is exerted upon the yarn 10. While the yarn is thus drawn off from the yarn holding device 8 the yarn brake 81 is in its braking position in which the yarn is braked between the inner wall of the yarn holding device 8 and the retention clothing 811 which is elastically applied to said inner wall, so that uncontrolled draw-off of yarn 10 from the yarn holding device 8 is not possible.

When the yarn end now reaches the yarn end monitoring device 83, the negative pressure at the suction pipe 6 is switched off and the overpressure at the torsion element 3 is switched on in function of this position being reached, so that the removal of the roving 1 is terminated and so that said roving 1 is instead now fed to the torsion element 3. Due to the twisting effect which now takes place, the yarn end and the drawn roving 1 are now twisted into a yarn 10.

Figure 5:
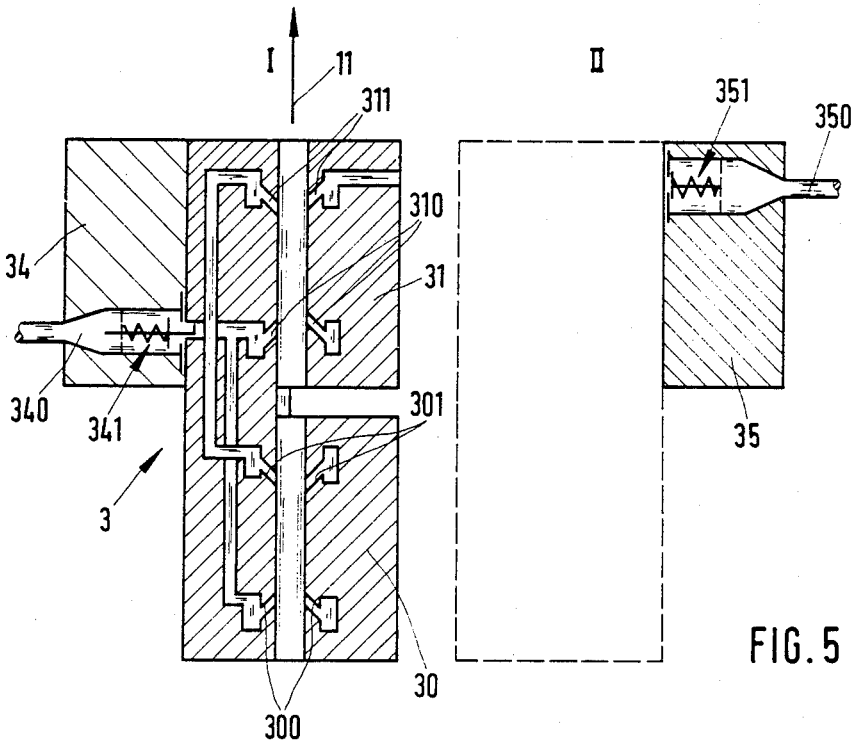
FIG. 5 shows a cross-section of a torsion element as well as two stops interacting with the torsion element in its two end positions.

FIG. 5 shows a torsion element 3 which, for reasons of clarity, is shown turned around its longitudinal axis by 90° as compared with the torsion element 3 shown in FIGS. 1 to 4. By its configuration, the torsion element 3 shown in FIG. 5 makes it possible for the yarn holding device 8 to execute merely a very simple movement or to be even stationary. The torsion element 3 in this case, in addition to a first set of compressed air bores 300 and 310 with a direction component in the direction of yarn draw-off (arrow 11), is furthermore provided with a second set of compressed air bores 301 and 311 with a direction component in the direction of feed-back. The first set of compressed air bores 300 and 310 is subjected to compressed air during spinning while the second set of compressed air bores 301 and 311 is subjected to compressed air during the feed-back of yarn 10 into the yarn holding device 8. Since in an embodiment with a torsion element 3 of such design, with two sets of compressed air bores 300/310 and 301/311, the yarn holding device 8 can be at a relatively great distance from the torsion element 3 in threading position II for the threading of the fed-back yarn, whereby the yarn 10 extends at a favorable angle to the torsion element 3 after the torsion element 3 has been returned into its spinning position I, no complicated drives for the yarn holding device 8 are needed.

According to FIG. 5 the torsion element 3 is associated with two stops 34 and 35 of which the stop 34 determines the spinning position I and the other stop 35 determines the threading position II of the torsion element 3. This second stop 35 can here be installed on the piecing carriage 9 so that it is attributed to the spinning station being serviced during piecing, so that a separate stop 35 need not be provided for each spinning station. Each stop 34 and 35 is equipped with an intake opening 340 or 350 for compressed air. The intake opening 340 for compressed air is here installed in the stop 34 so that it is connected to the compressed air openings 300 and 310 of the torsion element 3 when the latter is in spinning position I, while the intake opening 350 for compressed air is installed in the stop 35 so that it matches the compressed air openings 301 and 311 when the torsion element 3 is in threading position II.

The compressed air is here controlled by means of a valve 71 as shown in FIG. 6.

In the embodiment shown in FIG. 5, each intake opening 340 or 350 for compressed air is equipped with a check valve 341 or 351 which is opened when the torsion element 3 is applied against the corresponding stop 34 or 35, and closes automatically when said torsion element 3 is lifted off from said stops 34 or 35. It is thus no longer necessary to provide for separate control through control device 7 (as is the case with valve 71 shown in FIG. 6).

We claim:

1. A method for piecing after a thread break on a spinning device using a pneumatic torsion element for spinning into yarn roving fed thereto with a drafting means having pairs of rolls, said method comprising the steps of:

sensing breakage of yarn being fed to a winding means for winding yarn from said pneumatic torsion element;

responsive to such yarn breakage sensing, stopping roving being forwarded towards said pneumatic torsion element, while operating said winding means for feeding back an end of yarn from said winding means and then retaining such yarn end in a yarn holding device adjacent said drafting means;

removing a forward end of roving stopped in said drafting means and rendered unsuitable for piecing due to stoppage thereof, while treating the fed-back yarn end retained in said yarn holding device;

during said removing step, restarting yarn winding with said winding means, while no twisting action is exerted on said yarn with said pneumatic torsion element; and responsive to the position of said fed-back yarn end, bringing the yarn formerly retained in said yarn holding device laterally into said drafting means while operating same for feeding roving to said pneumatic torsion element and re-instating twisting action therein;

whereby the treated yarn end and roving unaffected by the previous stoppage thereof are fed together into said pneumatic torsion element as the torsion effect thereof is restarted, to be twisted into yarn having even and unobtrusive piecing joints.

2. Method as in claim 1, wherein the yarn is initially drawn off through the torsion element without any torsion effect being exerted by same upon the yarn, termination of the removal of roving and resumption of the feeding of roving to the torsion element is controlled as a function of the position of said fed-back yarn end, said roving subsequently being subjected together with the drawn-off yarn to restart of the twisting effect with said torsion element.

3. Method as in claim 1, wherein during subsequent feeding of roving, the yarn is introduced laterally into the closed clamping line of a pair of output rolls of the drafting mechanism, and is fed to the torsion element at a speed determined by the rotational speed of such pair of exit rolls.

4. Method as in claim 1, wherein the yarn to be brought together with the roving is retained pneumatically after resumption of yarn draw-off to prevent uncontrolled draw-off thereof and is furthermore braked mechanically until part of it is brought together with the roving.

5. Method as in claim 1, wherein such treating includes cutting the fed-back yarn end to a defined length before having it brought together with the roving.

6. Method as in claim 5, further characterized in that the position of the end of the yarn in the process of being fed together with said roving is sensed and in that further operating cycles are controlled as a function of the sensed position of the yarn end.

7. A device for piecing to a spinning apparatus having a controllable pneumatic torsion element for twisting roving fed thereto into yarn, winding means for alternately taking up yarn from said torsion element and feeding back a free yarn end to such torsion element to form fed-back yarn, and drafting means for feeding roving to torsion element, said device comprising:

suction means, adjacent the drafting means and the intake of the torsion element, for controllably removing roving therefrom;

roving braking means, adjacent the drafting means and upstream from said suction means, for controllably stopping roving in the drafting means;

yarn monitoring means, adjacent the yarn path between the torsion element and the bobbin means, for outputting a signal responsive to breakage of such yarn;

piecing control means, responsive to said yarn breakage signal, for successively operating said roving braking means so as to stop feeding roving to the torsion means, said suction means so as to remove a portion of the roving forward end rendered unsuitable for piecing by such stoppage, and said roving braking means so as to re-start feeding of roving to the torsion element together and combined with yarn fed-back to the upstream side of the torsion element by said winding means; and pneumatic yarn holding means including yarn end monitoring means therein for selectively holding a fed-back yarn end adjacent the drafting means and sensing the presence of a yarn end thereat, respectively, sensing thereof being used as an input to said piecing control means for selectively operating said roving braking means and said torsion element for providing the torsion effect thereof so that timing of the roving feeding re-start and release of the yarn end is effected for entry of the roving and yarn end together into the torsion device as the torsion effect restarts.

8. A device as in claim 7, wherein said pneumatic yarn holding means further includes a yarn brake for selectively holding yarn therein initially during yarn draw-off during piecing of such yarn.

9. A device as in claim 8, wherein said yarn brake may be selectively moved under control of said piecing control means in and out of the path of yarn extending towards said yarn holding means.

10. A device as in claim 7, wherein said yarn holding means comprises a suction pipe, and further includes a yarn brake located thereinside for selectively holding yarn received inside said suction pipe.

11. A device as in claim 7, further comprising a pretreatment means associated with said pneumatic yarn holding means for selectively pre-treating yarn held thereby.

12. A device as in claim 11, wherein said pretreatment means comprises a yarn cutting device for selectively trimming yarn received in said yarn holding means.

13. A device as in claim 7, wherein a piecing carriage may be used for selectively transporting said piecing control means alongside said spinning apparatus to any one of a plurality of spinning stations thereof at which a yarn break has been sensed by yarn monitoring means.

14. A device as in claim 13, wherein said piecing carriage also selectively transports said suction means, and means for actuating said roving braking means, and further transports yarn holding means for selectively holding yarn fed back by said spinning apparatus in a piecing-ready position adjacent the respective drafting means at such spinning station.

15. A device as in claim 7, wherein said pneumatic torsion element, having an injection nozzle region followed by a torsion nozzle region, includes a first pair of compressed air bore sets of compressed air bore sets having a direction component in the direction of yarn draw-off, said first pair of sets being respectively segregated between said injection nozzle and said torsion nozzle regions, and further includes a second pair of compressed air bore sets with a direction component in the direction of yarn feed-back, said second pair of sets being likewise segregated respectively between said regions.

16. A device as in claim 15, further comprising:

first stop means associated with said torsion element for determining a spinning position thereof, said first stop means being provided with a first compressed air intake opening connectable to said first pair of compressed air bore sets; and second stop means associated with said torsion element for selectively determining a threading position thereof, said second stop means being provided with a second compressed air intake opening connectable to said second pair of compressed air bore sets.

17. A device as in claim 16, wherein said compressed air intake openings are each respectively further provided with a check valve which is actuated so as to be opened whenever said torsion element is interactive with the corresponding stop means.

18. A device as in claim 16, wherein a piecing carriage is adapted for traveling alongside said spinning apparatus and selectively interacting with any spinning station thereof where a yarn breakage is sensed, and further wherein said piecing carriage selectively transports said second stop means to any one of such spinning stations.

19. A device as in claim 7, further comprising a suction nozzle situated just downstream from said torsion element and adjacent the path of yarn between said torsion element and the winding means, said suction nozzle being selectively actuated for removing loose fibers and fly from the torsion element whenever spinning operation is interrupted.

20. A spinning apparatus having a controllable pneumatic torsion element for twisting roving fed thereto into yarn, drafting means for feeding roving to said torsion element, and winding means for alternately drawing off and taking up yarn from said torsion element, and feeding back a free yarn end to such torsion element to form fed-back yarn for piecing, said torsion element having an injection nozzle region followed by a torsion nozzle region, and including a first pair of compressed air bore sets having a direction component in the direction of yarn draw-off, said first pair of sets being respectively segregated between said injection nozzle and said torsion nozzle regions, and including a second pair of compressed air bore sets with a direction component in the direction of yarn feed-back, said second pair of sets being likewise segregated respectively between said regions.

21. Apparatus as in claim 20, further comprising:

first stop means associated with said torsion element for determining a spinning position thereof, said first stop means being provided with a first compressed air intake opening connectable to said first pair of compressed air bore sets; and second stop means associated with said torsion element for selectively determining a threading position thereof, said second stop means being provided with a second compressed air intake opening connectable to said second pair of compressed air bore sets.

22. Apparatus as in claim 21, wherein said compressed air intake openings are each respectively further provided with a check valve which is actuated so as to be open whenever said torsion element is interactive with the corresponding stop means.

23. Apparatus as in claim 21, wherein a piecing carriage is adapted for traveling alongside said spinning apparatus and selectively interacting with any spinning station thereof where a yarn breakage is sensed, and further wherein said piecing carriage selectively transports said second stop means to any one of such spinning stations.

24. Apparatus as in claim 20, further comprising:

a suction nozzle situated just downstream from said torsion element and adjacent the path of the yarn between said torsion element and said winding means, said suction nozzle being selectively actuated for removing loose fibers and fly from the torsion element whenever spinning operation is interrupted.

* * * * *